US005108300A

United States Patent [19]

Weber

[11] Patent Number: 5,108,300

[45] Date of Patent: Apr. 28, 1992

[54] ELECTRICAL CONNECTOR WITH INTERLOCKED COMPONENTS

[75] Inventor: Ronald M. Weber, Lebanon, Pa.

[73] Assignee: AMP Incorporated, Harrisburg, Pa.

[21] Appl. No.: 686,908

[22] Filed: Apr. 16, 1991

[51] Int. Cl.[5] ..... H01R 13/66; H01R 13/703

[52] U.S. Cl. ..... 439/188; 439/581; 439/620; 439/903

[58] Field of Search ..... 439/188, 607, 609, 610, 439/620, 581, 903; 333/181-185

[56] References Cited

U.S. PATENT DOCUMENTS 4,659,162 4/1987 Cartesse ..... 439/557
4,666,231 5/1987 Sheesley et al. ..... 339/177 R
4,722,022 1/1988 Myers ..... 439/588
4,804,339 2/1989 Cohen ..... 439/188
4,884,982 12/1989 Fleming et al. ..... 439/620
4,906,208 3/1990 Nakamura ..... 439/607
5,030,122 7/1991 Birch et al. ..... 439/188

*Primary Examiner*—Neil Abrams
*Attorney, Agent, or Firm*—Gerald K. Kita

[57] ABSTRACT

An electrical connector 1 comprises, an insulative housing 2, a conductive shell 3 having electrical terminals 4, an insulator 5, conductive switch contacts 7, 8, an electrical circuit element 9 constructed to engage the shell 3 and the switch contact 8, and a conductive clip 10 is constructed to engage additional electrical circuit elements 11, and the housing 2, the shell 3 and the insulator 5 interlock for ease of assembly.

19 Claims, 5 Drawing Sheets

ELECTRICAL CONNECTOR WITH INTERLOCKED COMPONENTS

FIELD OF THE INVENTION

The invention relates to an electrical connector useful for interconnecting with a mating connector for coaxial cable, and particularly, component parts of such a connector, which interlock for ease of assembly.

BACKGROUND OF THE INVENTION

A connector is known from U.S. Pat. No. 4,884,982 and comprises, electrical capacitor elements inset within an outer profile of the connector, and a conductive clip holding said capacitor elements in pressure contact with a conductive shell of the connector. This known connector includes an electrical contact with an electrical receptacle portion within the shell of the connector.

Another known connector, disclosed in U.S. Pat. No. 5,030,122, comprises electrical switch contacts within a conductive shell of the connector.

In the known connectors described above, the component parts are not interlocked. Consequently, a manufacturing operation is required to fix in place the component parts. For the connector known from U.S. Pat. No. 4,884,982, a thin flange is flared outwardly. For the connector known from the U.S. Pat. No. 5,030,122, the shell is built from bipartite sections.

SUMMARY OF THE INVENTION

A feature of the invention resides in an electrical connector constructed with component parts including, an electrical contact means within a conductive shell, and wherein the component parts of the connector are constructed with interlocking features that permit the component parts to interlock with one another. Manufacture of the connector is simplified by having the parts constructed so as to interlock with one another.

According to the invention, an electrical connector comprises, a conductive shell having projecting terminals, electrical contact means held by an insulator in said shell, a cavity extending from an end of the insulator and received over said shell, channels extending from said end and along the cavity, the channels receiving said terminals, and the housing being constructed with latches for limiting relative movement of said housing and said shell.

Further according to the invention an electrical connector comprises, a conductive shell, electrical contact means held by an insulator in the shell, a circuit element received in a recess in the insulator engaging said electrical contact means, the circuit element and the insulator being slidable together along a cavity communicating with an end of the shell, and the insulator being constructed with latches for limiting relative movement of the insulator and the shell.

For an understanding of the invention, reference will now be made, by way of example, to a description of an embodiment of the invention taken in conjunction with accompanying drawings, according to which:

DETAILED DESCRIPTION

Figure 1:
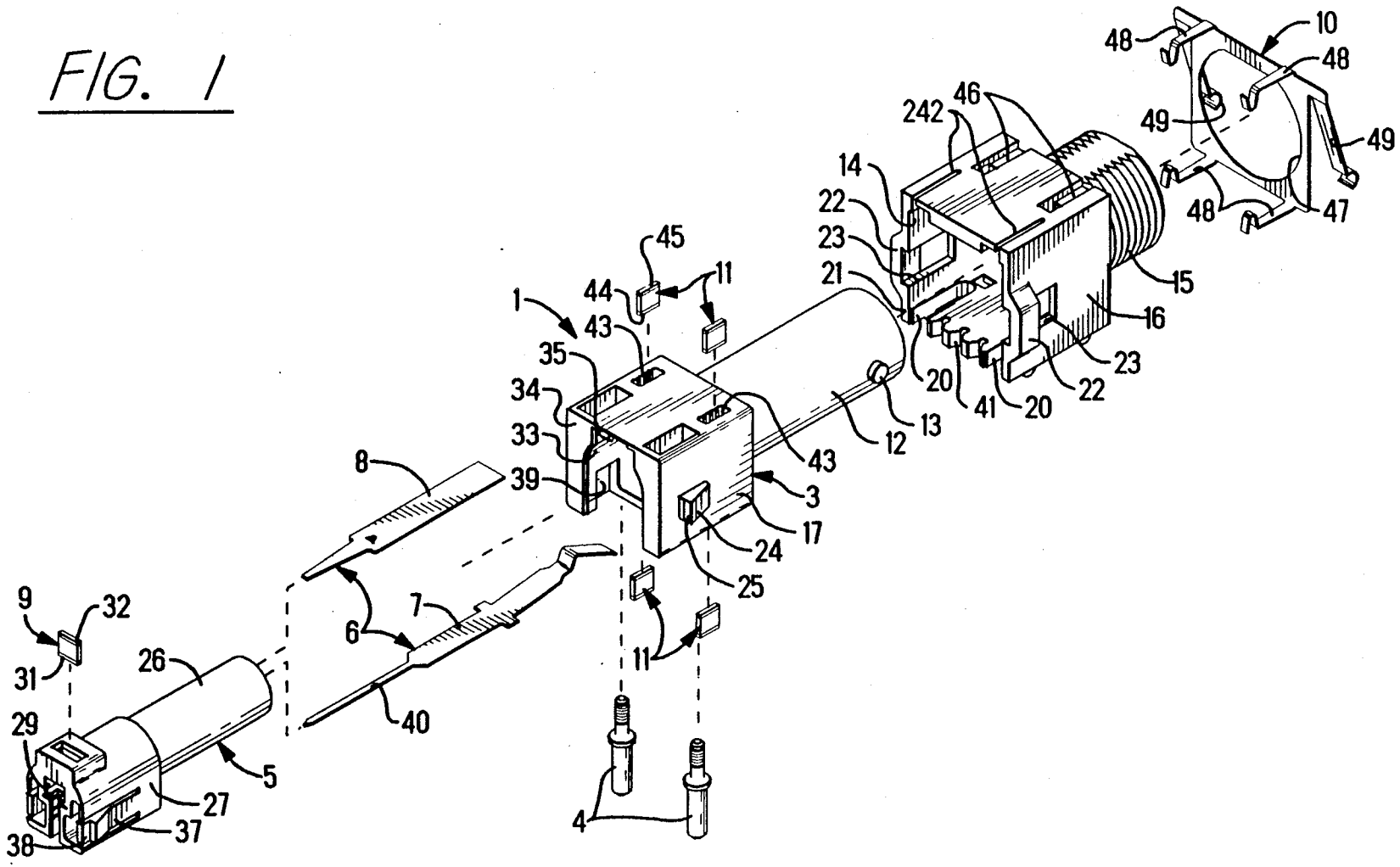
FIG. 1 is a perspective view of a connector with parts separated from one another.

With reference to FIG. 1 of the drawings, an electrical connector 1 comprises, an insulative housing 2, a conductive shell 3 having electrical terminals 4, an insulator 5, and contact means 6, for example, in the form of conductive switch contacts 7, 8. The contact means 6 can comprise other forms, for example, an electrical receptacle as disclosed in U.S. Pat. No. 4,884,982. Further disclosed in FIG. 1, an electrical circuit element 9 is constructed to engage the shell 3 and the switch contact 8, and a conductive clip 10 is constructed to engage additional electrical circuit elements 11. The housing 2, the shell 3 and the insulator 5 are constructed to interlock for ease of assembly.

Figure 2:
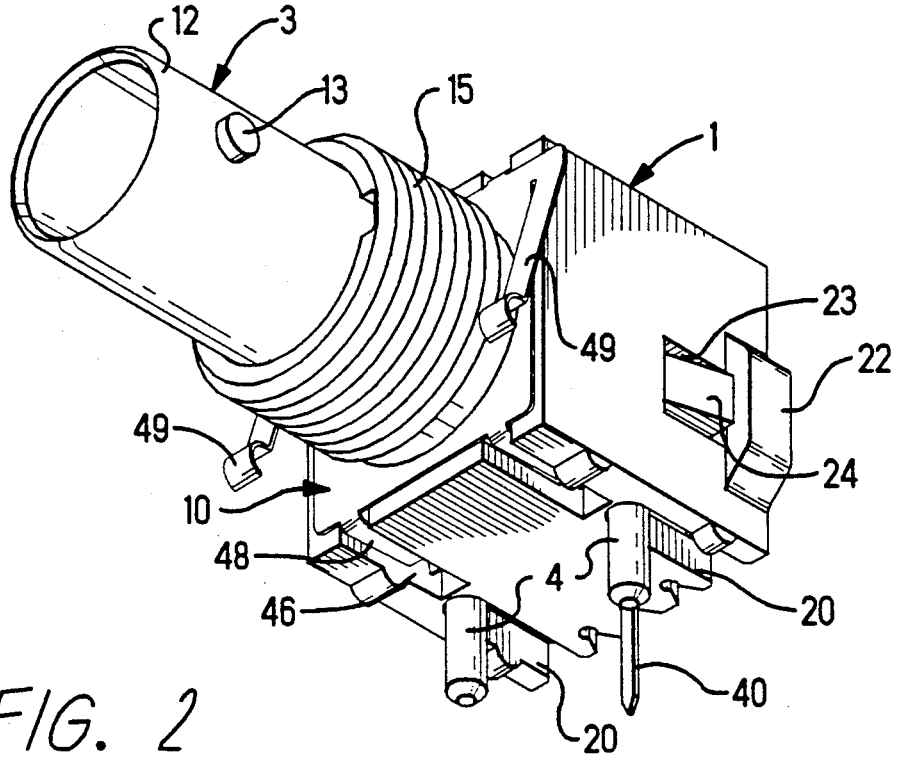
FIG. 2 is a perspective view of the connector with parts assembled.
Figure 4:
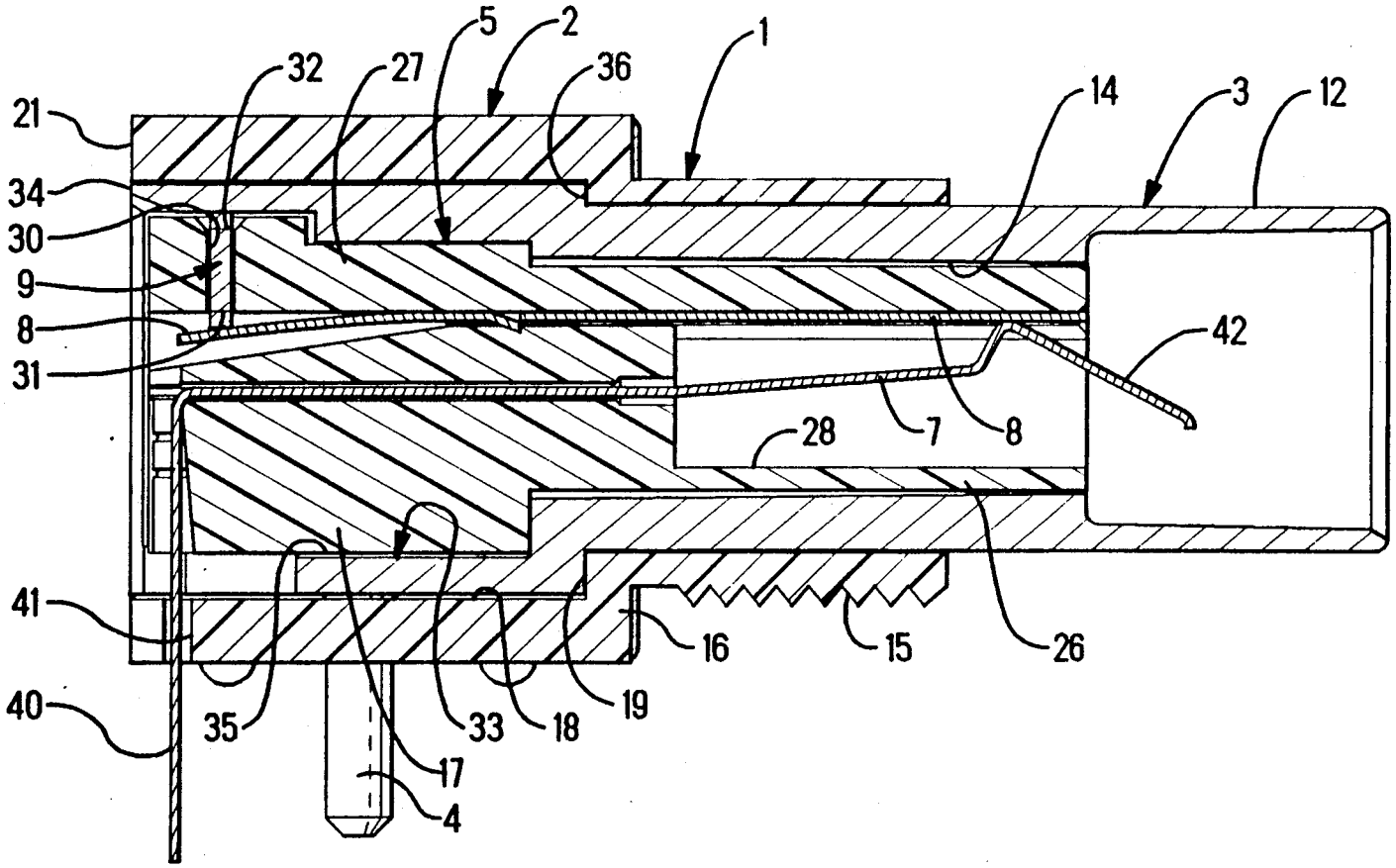
FIG. 4 is a longitudinal section view of the connector.
Figure 5:
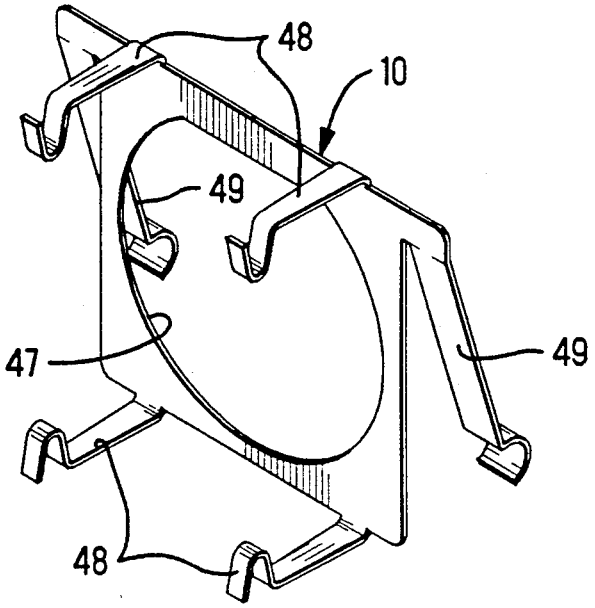
FIG. 5 is a perspective view of a clip of the connector.

With reference to FIGS. 1 and 4, the shell 3 is of unitary construction, and has a forward, hollow cylindrical portion 12 of reduced perimeter profile provided with bayonet coupling prongs 13, FIGS. 1 and 2, for connection with a mating electrical connector, not shown, in a manner disclosed in the U.S. Pat. No. 5,030,122, identified above.

With reference to FIGS. 1 and 4, the housing 2 is unitary in construction, and includes, a stepped passage 14 extending through an outer cylindrical portion 15 externally threaded, and through a rectangular block portion 16. The housing 2 is received over the shell 3. A relatively enlarged, hollow noncylindrical portion 17 of the shell 3 fits within a conforming, noncylindrical portion 18 of the passage 14 to prevent relative rotation between the housing 2 and the shell 3. The noncylindrical portion 17 of the shell engages against a rear facing shoulder 19 of the passage 14.

Figure 7:
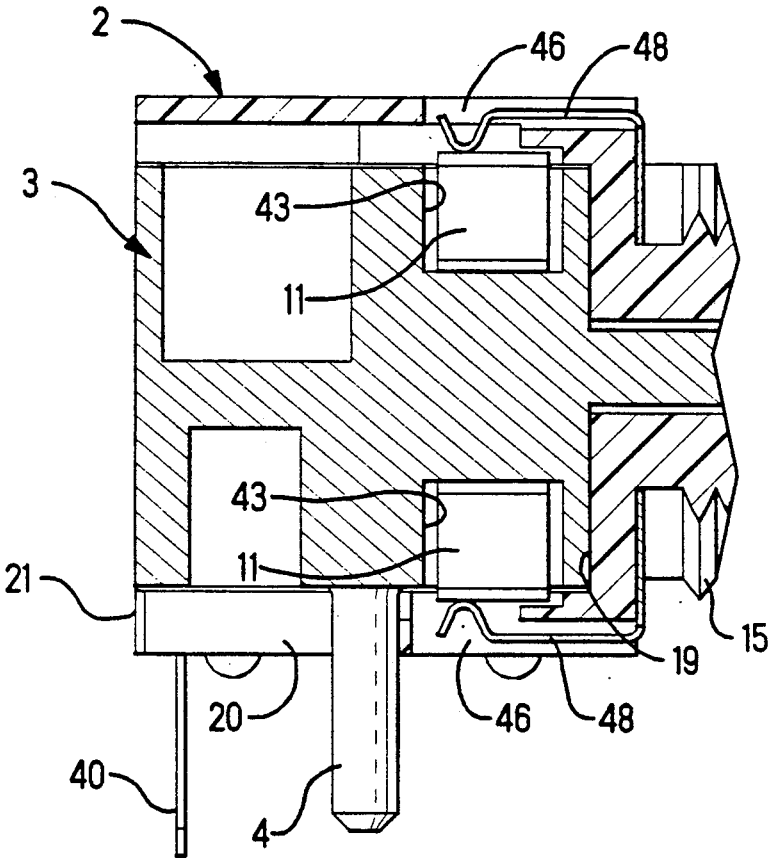
FIG. 7 is a fragmentary section view of the connector.

With reference to FIGS. 1 and 7, the terminals 4 are press fit to the shell 3 prior to assembly of the shell 3 with other component parts. The housing 2 is constructed for ease of assembly with the combination of the shell 3 and the terminals 4. Terminal receiving slots 20 communicating with and extending from a rear end 21 of the housing 2 receive there through the terminals 4 during assembly of the housing 2 over the shell 3. The housing 2 includes latches 22 in the form of straps overlying channels 23 extending from and communicating with the end 21 of the housing 2. The channels 23 slidably receive projecting latch fingers 24 of the shell 3, FIGS. 1 and 2. The latch fingers 24 are front tapered wedges that wedge and resiliently deflect the latches 22 outwardly during passage of the latch fingers 24 along the channels 23. Rear facing shoulders 25 of the latch fingers 24 then latch against the latches 22 to prevent withdrawal of the shell 3 from the housing 2, and to limit relative movement of the housing 2 and the shell 3. The described latches 22 comprise latching means on the housing 2 in cooperation with the combined shell 3 and terminals 4 to limit relative motion of the housing 2 and the shell 3 and withdrawal of the shell 3. Pivoted movement of latches 22 is permitted by resilient opening of the slits 242 and the slots 20 in the housing 2.

With reference to FIGS. 1 and 4, the insulator 5 of unitary construction includes a front cylindrical portion 26 and a relatively enlarged noncylindrical portion 27. A first contact receiving cavity 28 receives the switch contact 7 therein. The first contact receiving cavity 28 receives the second switch contact 8 which extends into a second contact receiving cavity 29. The first switch contact 7 is resiliently biased in engagement against the second switch contact 8. The electrical circuit element 9, for example, a resistor, is held in a recess 30 in a side of the insulator 5. One conductive surface 31 of the circuit element 9 engages the second switch element 8. A second conductive surface 32 of the circuit element 9 faces toward an open side of the recess 30.

The shell 3 is received over the preassembled, combination of the insulator 5, contacts 7, 8 and circuit element 9. A passage 33 of the hollow shell 3 with a stepped interior communicates with a rear end 34 of the shell 3 and slidably receives the insulator 5. The second conductive surface 32 of the circuit element is slidable together with the insulator 5 along the passage 33. The interior of the shell 3 drives the circuit element 9 deeper into the recess 30. The switch contact 8 is deflected by the circuit element 9. In turn, the switch contact 8 resiliently biases the circuit element 9 in contact against the interior of the shell 3.

The noncylindrical portion 27 of the insulator 5 is received by a conforming noncylindrical portion 35 of the passage 33 of the shell 3 to prevent relative rotation of the insulator 5 and the shell 3. A front of the noncylindrical portion 27 of the insulator 5 engages a rear facing shoulder 36 of the passage 33. The insulator is provided with resilient latch fingers 37 with forward tapered wedges and rear facing shoulders 38. The latch fingers 37 are biased inward by the interior of the shell 3 and register in recesses 39 in the interior of the shell to resist withdrawal of the insulator 5 from the shell 3. With reference to FIG. 4, the switch contact 7 has an electrical terminal 40 that projects from the insulator 5. The terminal 40 can be bent to project into a corresponding, terminal receiving slot 41 communicating with and extending from the rear end 21 of the housing 2 to extend in the same direction as the terminals 4 for connection with a printed circuit board, not shown.

With reference to FIG. 4, a front end 42 of the switch contact 7 extends toward a front of the connector 1, and is constructed for resilient spring deflection away from the switch contact 8, when the connector 1 is connected with a complementary connector, not shown, as described in the U.S. Pat. No. 5,030,122, referred to above. An electrical circuit comprising, the switch contacts 7, 8, the circuit element 9 and the shell 3 is interrupted when the switch contacts 7, 8 disengage from each other. When the connector 1 is disconnected from a complementary connector, not shown, the connector 1 is self terminating, such that the switch contacts 7, 8 engage to complete the electrical circuit and provide an electrical load via the circuit element 9 instead of an open circuit condition at the contacts 7, 8.

With reference to FIGS. 1 and 7, the shell 3 has multiple pockets 43 recessed in the perimeter profile of the shell 3. Each pocket 43 is constructed to receive a corresponding, electrical circuit element 11, for example, a capacitor, having a first conductive surface 44 engaging a bottom conductive surface of the pocket 43, and a second conductive surface 45 facing toward a corresponding groove 46 in the housing 2. Each groove 46 is recessed from the perimeter profile of the housing 2.

Figure 3:
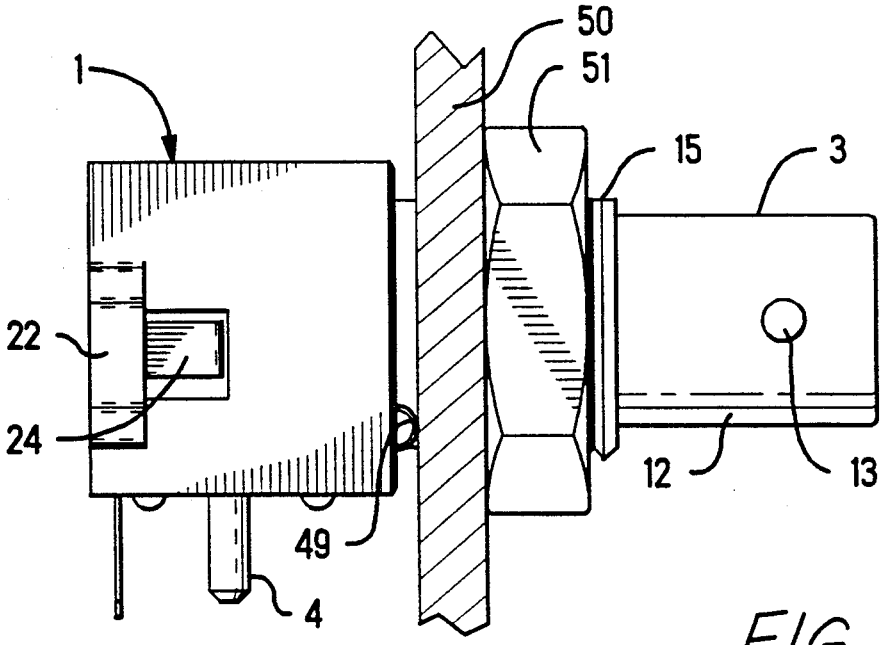
FIG. 3 is an elevation view of the connector mounted in a panel opening.
Figure 6:
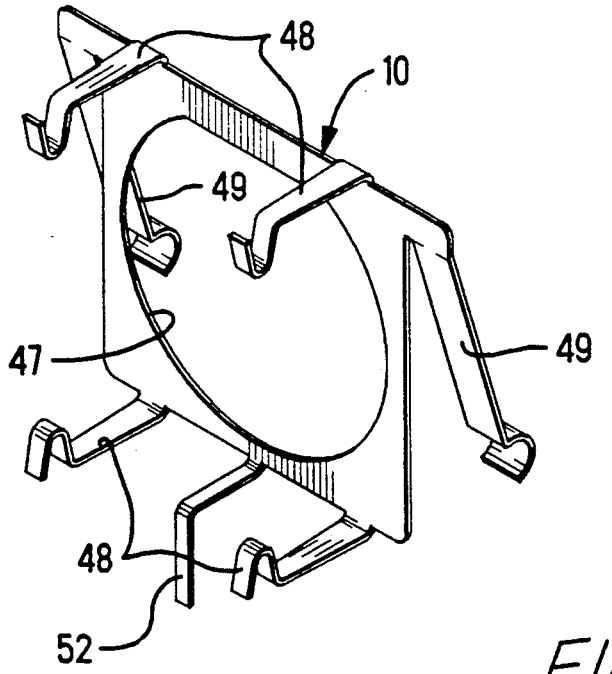
FIG. 6 is a perspective view of an alternate clip of the connector.

With reference to FIGS. 1, 2, 5 and 6, the conductive clip 10 is unitary, and has a central opening 47 received over the cylindrical portion 15 of the housing 2. The clip 10 has a series of spring fingers 48 that extend along the grooves 46 and are biased to resiliently engage those corresponding circuit elements 11 that are present in the pockets 43. A set of additional spring fingers 49 extend outwardly to engage compressively against a conductive portion of a panel 50, FIG. 3, through which project the cylindrical portion 15 of the housing 2 and cylindrical portion 12 of the shell 3. A threaded nut 51 secures the housing 2 to the panel 50. The clip 10 establishes an electrical connection of the shell 3 through each corresponding circuit element 11 to the panel 50. For example, if the circuit elements 11 are capacitors, the shell 3 is capacitively coupled electrically with the panel 50 through the capacitors. In FIG. 6 is shown a clip 10 with an electrical terminal 52 projecting in the same direction as the terminals 4, 40 for connection with a printed circuit board, not shown.

I claim:

1. An electrical connector comprising:

electrical contact means held by an insulator in the shell, an electrical circuit element received in a recess in the insulator and engaging said electrical contact means,

[the circuit element and the insulator being slidable together along a cavity communicating with an end of the shell, and the insulator being constructed with latches for limiting relative movement of the insulator and the shell,]

pockets means engaged against another conductive surface of said circuit element for establishing an external electrical connection.

2. An electrical connector as recited in claim 1, wherein a noncylindrical portion of the insulator fits with a conforming portion of the shell to prevent relative rotation between the insulator and the shell.

3. An electrical connector as recited in claim 1, and further comprising:

the shell having additional pockets receiving corresponding additional circuit elements, an insulative housing received over the shell, and said means comprises a conductive clip received over the housing and engaging the additional circuit elements.

4. An electrical connector comprising: an insulative housing, a conductive shell assembled with the insulative housing by sliding into a first passage in a rear end of the insulative housing, first latching means slidably engaged by the shell for latching together the insulative housing and the shell, an insulator assembled with the shell by sliding into a second passage in a rear end of the shell, second latching means slidably engaged by the insulator for latching together the insulator and the shell, a circuit element in a recess of the insulator assembled against the shell by sliding into a recess in a rear end of the shell, conductive contact means in the insulator engaging the circuit element for interrupting an electrical circuit through the shell, through the circuit element and through the conductive contact means, and a terminal of the conductive contact means projecting from the insulator.

5. An electrical connector as recited in claim 4, and further comprising: electrical terminals projecting from the shell and assembled with the insulative housing by sliding along terminal receiving slots in the rear end of the insulative housing.

6. An electrical connector as recited in claim 4, wherein, the conductive contact means comprises; a conductive first switch contact engaging the circuit element, and a conductive second switch contact engaging the first switch contact and constructed for deflection to disengage from the first switch contact, the terminal projecting from the second switch contact.

7. An electrical connector as recited in claim 4, wherein, the first latching means comprises, latches of the insulative housing, and latch fingers of the shell engaged against the latches.

8. An electrical connector as recited in claim 4, wherein, the second latching means comprises; resilient latch fingers of the insulator constructed for being biased inward by the housing, and rear facing shoulders of the latch fingers for registration in recesses in the shell to resist withdrawal of the insulator from the shell.

9. An electrical connector as recited in claim 4, and further comprising: pockets in the shell, additional circuit elements in the pockets engaging the shell, and a conductive clip received over a portion of the insulative housing with spring fingers engaging the additional circuit elements, and additional spring fingers of the clip for engaging a panel.

10. An electrical connector as recited in claim 9, and further comprising: grooves in the insulative housing, and the spring fingers of the clip being received along the grooves to engage the additional circuit elements.

11. An electrical connector as recited in claim 4, and further comprising: additional circuit elements engaging the shell and extending in the insulative housing, a conductive clip received over a portion of the insulative housing, spring fingers of the clip engaging the additional circuit elements, and additional spring fingers of the clip for engaging a panel.

12. An electrical connector as recited in claim 4, wherein, the contact means and the insulator extend in a cylindrical from portion of the shell, and a front portion of the insulative housing is over the front portion of the shell.

13. An electrical connector comprising: an insulative housing, a conductive shell assembled with the insulative housing by sliding into a first passage in a rear end of the insulative housing, first latching means slidably engaged by the shell for latching together the insulative housing and the shell, an insulator assembled with the shell by sliding into a second passage in a rear end of the shell, second latching means slidably engaged by the insulator for latching together the insulator and the shell, conductive contact means in the insulator, a terminal of the conductive contact means projecting from the insulator, a terminal receiving slot in the housing for receiving the terminal therethrough, and electrical terminals projecting from the shell and assembled with the insulative housing by sliding along terminal receiving slots in the rear end of the insulative housing.

14. A electrical connector as recited in claim 13, and further comprising electrical terminals projecting from the shell and assembled with the insulative housing by sliding along additional terminal receiving slots in the rear end of the insulative housing.

15. An electrical connector comprising: an insulative housing, a conductive shell assembled with the insulative housing by sliding into a first passage in a rear end of the insulative housing, first latching means slidably engaged by the shell for latching together the insulative housing and the shell, an insulator assembled with the shell by sliding into a second passage in a rear end of the shell, second latching means slidably engaged by the insulator for latching together the insulator and the shell, conductive contact means in the insulator, a terminal of the conductive contact means projecting from the insulator, a terminal receiving slot in the housing for receiving the terminal therethrough, and the first latching means comprises; latches of the insulative housing, slits in the insulative housing permitting movement of the latches, and latch fingers of the shell engaged against the latches.

16. An electrical connector as recited in claim 13, wherein, the second latching means comprises; resilient latch fingers of the insulator constructed for being biased inward by the shell, and rear facing shoulders of the latch fingers for registration in recesses in the shell to resist withdrawal of the insulator from the shell.

17. An electrical connector comprising: an insulative housing, a conductive shell assembled with the insulative housing by sliding into a first passage in a rear end of the insulative housing, first latching means slidably engaged by the shell for latching together the insulative housing and the shell, an insulator assembled with the shell by sliding into a second passage in a rear end of the shell, second latching means slidably engaged by the insulator for latching together the insulator and the shell, conductive contact means in the insulator, a terminal of the conductive contact means projecting from the insulator, a terminal receiving slot in the housing for receiving the terminal therethrough, pockets in the shell, circuit elements in the pockets engaging the shell, and a conductive clip received over a portion of the insulative housing with spring fingers engaging the circuit elements, and additional spring fingers of the clip for engaging a panel.

18. An electrical connector as recited in claim 17, and further comprising: grooves in the insulative housing, and the spring fingers of the clip being received along the grooves to engage the circuit elements.

19. An electrical connector comprising: an insulative housing, a conductive shell assembled with the insulative housing by sliding into a first passage in a rear end of the insulative housing, first latching means slidably engaged by the shell for latching together the insulative housing and the shell, an insulator assembled with the shell by sliding into a second passage in a rear end of the shell, second latching means slidably engaged by the insulator for latching together the insulator and the shell, conductive contact means in the insulator, a terminal of the conductive contact means projecting from the insulator, a terminal receiving slot in the housing for receiving the terminal therethrough, circuit elements engaging the shell and extending in the insulative housing, a conductive clip received over a portion of the insulative housing, spring fingers of the clip engaging the circuit elements, and additional spring fingers of the clip for engaging a panel.

* * * * *